United States Patent [19]

Pavie et al.

[11] Patent Number: 4,778,062

[45] Date of Patent: Oct. 18, 1988

[54] SYSTEM FOR CODING FLAT OBJECTS, IN PARTICULAR LETTERS

[75] Inventors: Claude Pavie, Houilles; Patrick Guebey, Parmain, both of France

[73] Assignee: Compagnie General D'Automatisme CGA-HBS, Paris, France

[21] Appl. No.: 909,068

[22] Filed: Sep. 18, 1986

[30] Foreign Application Priority Data

Sep. 18, 1985 [FR] France ..... 85 13831

[51] Int. Cl.[4] ..... B07C 1/00; B07C 3/20

[52] U.S. Cl. ..... 209/546; 209/584; 209/900; 382/1; 382/57

[58] Field of Search ..... 209/3.1–3.3, 209/569, 583, 584, 546, 900; 235/475–477; 382/1, 57

[56] References Cited

U.S. PATENT DOCUMENTS

| | | | |
|---|---|---|---|
| 3,587,856 | 6/1971 | Lemelson | 209/900 X |
| 4,068,212 | 1/1978 | Templeton | 382/57 |
| 4,155,842 | 5/1979 | Wallace et al. | 209/583 X |
| 4,488,610 | 12/1984 | Yankloski | 209/900 X |
| 4,632,252 | 12/1986 | Haruki et al. | 209/584 X |

FOREIGN PATENT DOCUMENTS

| | | | |
|---|---|---|---|
| 0148487 | 7/1985 | European Pat. Off. | 209/900 |
| 2945386 | 5/1980 | Fed. Rep. of Germany | 209/584 |
| 0267315 | 8/1964 | Netherlands | 209/900 |

*Primary Examiner*—Robert B. Reeves
*Assistant Examiner*—Edward M. Wacyra
*Attorney, Agent, or Firm*—Sughrue, Mion, Zinn, Macpeak & Seas

[57] ABSTRACT

A system for coding flat objects, in particular letters, comprises a manual coding station to enable a human operator to print coded indications on flat objects that a conveyor moves before him, using a printer. An optical addressing information reader on the upstream side of the manual coding station is adapted to control the printing of coded indications appropriate to information previously marked on the objects that it is able to recognize. A switching device on the path of the conveyor on the downstream side of the optical reader is used to route the objects to the printer from the optical reader either directly or via the manual coding station, where the operator controls the printing of coded indications appropriate to information previously marked on the objects marked on the objects that he is able to recognize.

5 Claims, 7 Drawing Sheets

SYSTEM FOR CODING FLAT OBJECTS, IN PARTICULAR LETTERS

BACKGROUND OF THE INVENTION

1. Field of the Invention

The present invention concerns a system for coding flat objects and in particular letters sent by mail.

2. Description of the Prior Art

In the known manner mail is coded to enable it to be sorted by automatic sorting machines during its transfer from the sender to the addressee via the mail organisation responsible for processing the mail.

The mail is usually coded with routing indicators so that it can be sorted for despatch to distribution offices or with distribution indicators so that it can be sorted for distribution to the addressees. These indicators are marked in coded form on the letters according to the addresses indicated by the senders, by means of printers.

The addresses are read either by human operators or by special-purpose optical readers. Such special-purpose optical readers do not generally have the adaptability of human operators and the mail that they are able to process has to conform to much stricter specifications.

The processing time assigned to such optical readers is exactly the same for all letters and as short as possible because of throughput considerations, leading to the use of high-speed, complex and therefore costly readers that have to be shared between a number of operators.

An object of the present invention is to combine the advantages of automatic coding by optical readers with those offered by manual coding by combining an optical reader with each manual coding station and making provision for varying the processing time according to inputting difficulties so as to offer an optimum throughput of mail, to limit the number of rejects due to failure to read the address and to optimize the work of the human operators.

SUMMARY OF THE INVENTION

The invention consists in a system for coding flat objects according to addressing information marked on the objects, comprising a conveyor, a manual coding station including a printer used by a human operator to print codes on said objects as they are moved past the station on said conveyor, an optical system for reading said addressing information located on the path of said conveyor on the upstream side of said coding station and adapted to control said printer so that it prints codes on said objects according to said addressing information, and a switching device on the downstream side of said optical system adapted to route said objects to said printer either directly or via said manual coding station and actuated by said optical system so that if it is unable to read the addressing information on an object that object is routed to said printer via said manual coding station.

The invention and its characteristics and advantages will now be described with reference to the appended drawings.

DESCRIPTION OF THE PREFERRED EMBODIMENT

Figure 1:
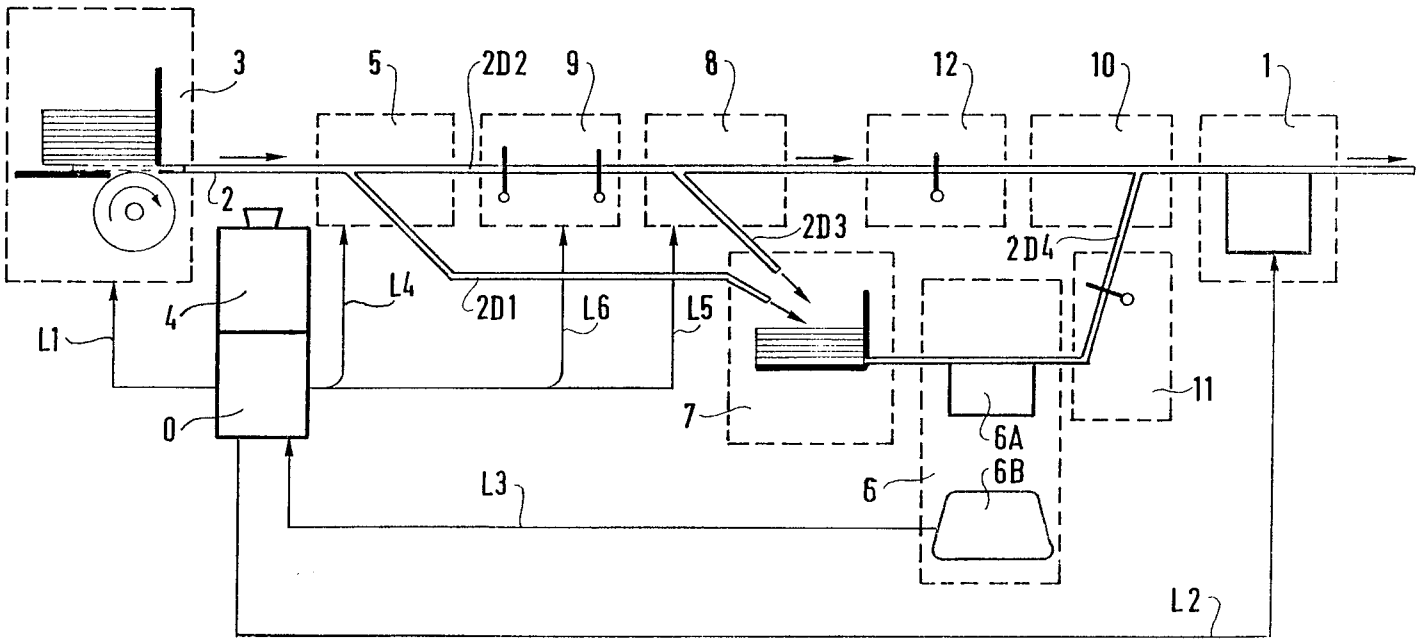
FIG. 1 is a general block schematic of a coding system in accordance with the invention.

The coding system shown in FIG. 1 is designed to enable coded indications to be marked on flat objects, in particular letters sent by mail, according to information written or printed on the objects to specify the postal address of their addressee. As previously mentioned, these coded indications are, for example, routing indicators or distribution indicators and they are presented on the letters in a form recognizable by sorting machines and suitably trained personnel; their composition is thus likely to vary according to the requirements of the users and according to the marking and reading equipment employed; they are usually distinctive printed marks in the form of parallel bars at predetermined spacings, or possibly alphanumeric inscriptions.

The required coded indications are printed on the letters by means of a printer 1, of the ink-jet type, for example, appropriately positioned along the length of a conveyor 2 which transfers the letters in the coding system between an unstacker store 3, in which the letters to be coded are stored, and a storage system receiving the coded letters, consisting for example of stackers that are not shown.

The unstacker store 3 is designed to accommodate a large number of letters, one thousand letters, for example, which are stacked against each other and can be extracted one by one from one end of the unstacker store 3 which is appropriately designed for this purpose, as will subsequently be explained with reference to the example shown in FIG. 3. A logic system 0 based in the conventional way on at least one processor controls the removal of letters one by one from the unstacker store 3 via a control link L1.

Each letter passes from the unstacker store 3 to the storage system through the intermediary of the conveyor 2 which conventionally comprises movable members such as pulleys or drive belts and fixed members of the guide or slideway type procuring displacement of the letters one by one between the mobile and/or fixed members along a predetermined path, each letter being moved by pulleys or belts bearing against at least one side of the letter.

An optical reader 4 is placed on the path of the conveyor 2 on the downstream side of the unstacker store 1 so that it scans the separately passing letters leaving the unstacker store one by one, under the control of the logic unit 0, in order to determine the position of the existing inscriptions needed for coding purposes and to read these inscriptions.

The optical reader 4 is of conventional design and will be described only in outline here, its specific structure being only indirectly related to the present invention. The optical reader comprises in the conventional way an arrangement for illuminating the surface to be read and a lens concentrating light reflected from this surface onto an optical sensor system usually made up of photodiodes. This optical sensor system produces electrical signals according to the light that it receives and transmits them to the logic unit 0.

The logic unit compares the signals that it receives from the optical sensor system with those stored in a character memory (not shown) in the logic unit in order to translate into predetermined numerical combinations the various characters recognized as a result of such comparison. The images provided by the optical sensor are stored for used by the logic unit and possibly by the manual coding station.

In particular, this enables the logic unit to retain an image for translation purposes for a variable time, until the characters are recognized or rejected, circulation of the letters on the conveyor being uninterrupted because of the switching and temporary halting possibilities of the conveyor.

Some known optical readers incorporate the logic unit 0, one example of a reader of this kind being described in European patent application No. 0063243.

As an alternative to this, the logic unit 0 may be external to the reader because of its coordination function within the system, and in particular so as to provide a solution to problems due to parallel action of the operator and the optical reader.

In either case the means employed are not described further here since they are well known to those skilled in the art.

As already indicated, the optical reader 4 attempts to decipher the inscriptions which are necessary for coding a letter as the letter passes before it on the conveyor 2 provided for this purpose. For example, the conveyor comprises an opening forming a viewing window facing the optical sensor so that this can scan the part of the front of the letter on which the inscriptions to be read are likely to appear.

A switching device 5 is disposed on the path of the conveyor 2 on the downstream side of the optical reader, this switching device 5 being intended to route differently the letters for which the reader is able to take a decision after reading them and those for which human intervention or longer processing by the optical reader is necessary; it is also used to feed letters to the human operator as and when required.

The optical reader 4 transmits letters to the manual coding station in certain cases, for example if it is unable to determine the location of the inscriptions to be acted on for any reason, for example because of abnormal positioning of these inscriptions or irrelevant inscriptions likely to lead to confusion. The optical reader 4 passes letters in such a way as to bypass the manual coding station either because it has read or because the inscriptions are unambiguous, for example if the letter is already coded or if the side of the letter examined is blank. A first outlet from the switching device 5 therefore leads to the manual coding station 6 via a branch 2D1 of the conveyor 2 and a buffer store 7 in which accumulate letters to be examined by a human operator servicing the manual coding station.

The branch 2D1 consists, like the branch 1, of a conventional system (not shown) of pulleys and/or drive belts holding the letters between them and moving them one after the other, usually in a vertical position.

The buffer store 7 is an unstacker/stacker store preferably of the first in—first out type to be described later.

The manual coding station 6 is a conventional arrangement comprising a viewing unit 6A, either for direct viewing or using a visual display unit screen, enabling an operator to see at least one of the two sides of a letter in order to code the letter using a coding keyboard 6B and according to the inscriptions read from it.

The screen could receive images read by the optical sensor of the reader and stored for use at the manual coding station.

The viewing unit 6A may consist of a video system comprising a camera feeding a monitor (not shown), in one embodiment, it essentially comprises a device for illuminating the letters to be coded, separately or in small groups, this device possibly being that of the optical reader, and for viewing them through a window formed in one side of the branch 2D1 of the conveyor 2.

The keyboard 6B is a conventioanl keyboard the keys of which are preferably adapted ergonomically and specifically to the coding tasks to be carried out; it is connected to the printer 1 via the logic unit 0 and two links L2 and L3 to transmit coding orders to it, in the same way as the optical reader 4 does for the letters that it processes. The keyboard 6B also enables the human operator to actuate the switching device 5 via the logic unit 0 and a control link L4, in the same way as the optical reader 4.

A second outlet from the switching device 5 leads to a second switching device 8 via a branch 2D2 of the conveyor 2. The second switching device 8 is used to route the letters that it receives either to the buffer store 7 via a branch 2D3 or to the printer 1 via the branch 2D2; it is normally controled by the optical reader 4 via the logic unit 0 and a control link L5, according to the result of the reading operations.

A double barrier 9 is inserted between the switching devices 5 and 8 to hold back one by one the letters carried by the branch 2D2 for as long as the optical reader 4 has not terminated its analysis.

If the analysis carried out on a letter on the basis of the information sensed from one side of the letter by the optical reader does not indicate any of the coding possibilities provided for at the end of a predetermined maximum time the letter concerned is passed to the manual coding station for deciphering.

In one embodiment of the proposed coding system the analysis of each letter does not require the letter to remain in front of the optical reader 4 because the information supplied by the optical sensor system of the reader for the letter in question is stored. By virtue of this fact the letter can be fed by the conveyor 1 to the switching device 5 and through it while processing of the information relating to this letter by the processor of the optical reader 4 is continuing so that a further letter can be placed without loss of time in front of the optical reader 10.

The double barrier 9 controled by the optical reader 4 via the logic unit 0 and a link L6 is used to hold back by means of a first barrier element any letter carried by the branch D2 via the switching device 5 if the processing of the information relating to this letter by the processor of the optical reader 4 has not been completed and as a result of this no decision has been taken as to whether to route this letter towards the manual coding station 6 or towards the printer 1 via the second switching device 8; a second barrier element on the upstream side of the first also makes it possible to halt a letter following on behind a letter halted behind the first element.

At the end of processing by the optical reader 4, if the letter concerned cannot be coded it is forwarded to the manual coding station 6; to this end it is routed towards the buffer store 7 via the second switching device 8 and the branch 2D3; otherwise it continues towards the printer 1 along the branch 2D2.

The printer 1 receives some letters for coding from the optical reader 4 via the branch 2D2 and other letters for coding from the manual coding station 6; it is therefore fed by a merging device 10 of the conveyor at which terminate the branch 2D2 and a merging branch 2D4 joined to the branches 2D1 and 2D3 via the buffer store 7 and the manual coding arrangement.

The two branches 2D2, 2D4 are each provided with a barrier 11, 12 for temporarily holding back a letter during its transfer to the printer 1, in order to prevent any overlapping of two letters arriving simultaneously each on a different branch 2D2 or 2D4.

To this end the barriers 11 and 12 are controled by the logic unit 0 via selection links (not shown) so as to prevent them opening simultaneously, priority being assigned to one of them, the barrier 11, for example.

In one embodiment all the letters supplied by the unstacker store pass via the printer 1 for coding under the control of the optical reader 4 or the manual coding station 6; in this instance the printer does not code letters for which no code has been determined by the reader or the operator because of the degree to which they are abnormally addressed.

Figure 2:
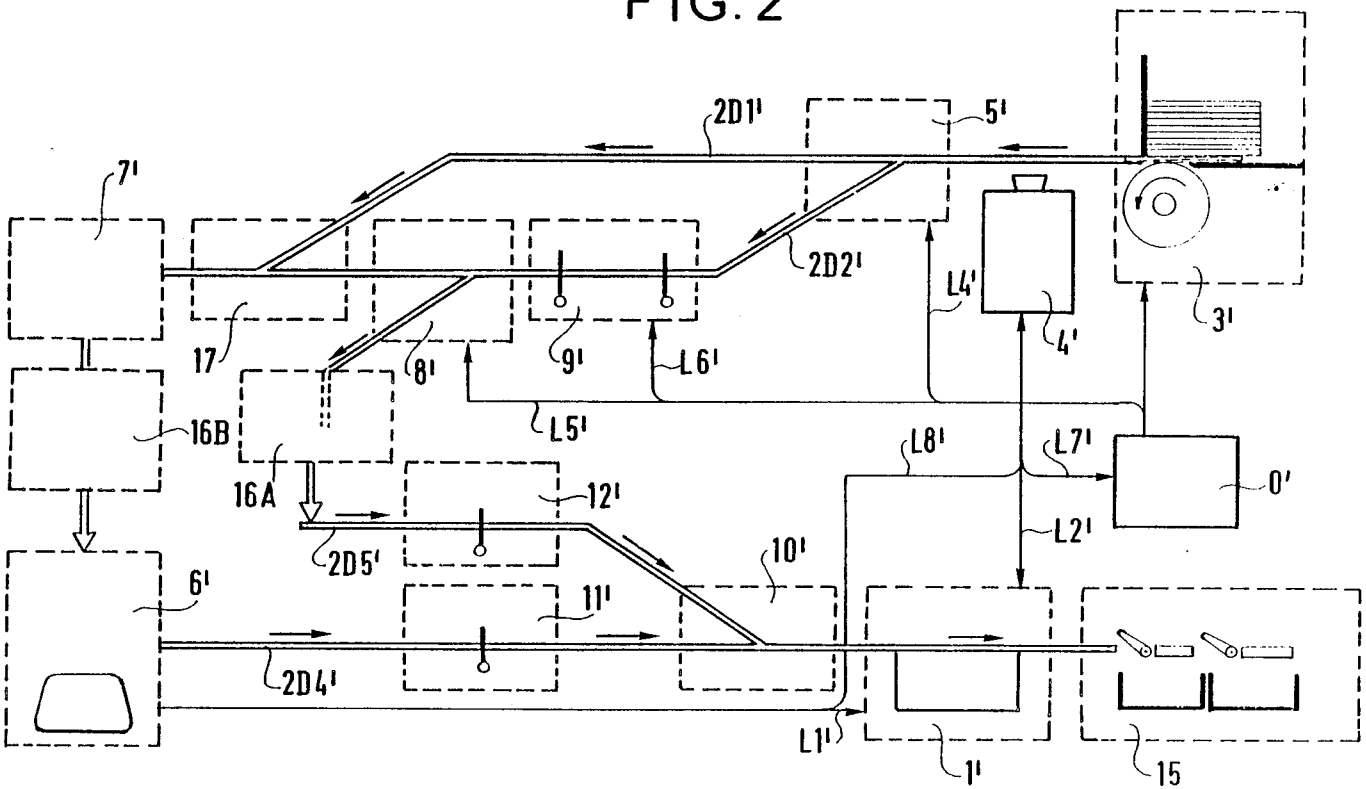
FIG. 2 is a general block schematic of an alternative embodiment of coding system in accordance with the invention.

FIG. 2 shows an alternative embodiment intended to make the coding system more compact, given that the overall size of a sorting system comprising a system of this kind is often large, so that there are benefits in reducing it.

The coding system shown in FIG. 2 is characterized by an arrangement of its component parts on two levels, commensurately reducing the floorspace occupied, this being facilitated by the relatively restricted height required for these component parts, which is related to the usual size of letters.

As previously, the coding system in accordance with the invention comprises a printer 1' having the same structure and the same functions as the printer 1, this printer being, for example, a TILJE printer as manufactured by the assignee company.

The printer 1' is fed with letters to be coded front an unstacker store 3'. The store 3' is of the so-called horizontal type, its practical disposition being shown in FIG. 3 and in FIG. 7; in the latter embodiment it has a surface 13 on which the letters 14 rest and which slopes upwards towards the extraction end from which the letters are fed along the conveyor.

An optical reader 4' is disposed at the exit from the unstacker store 3' (FIGS. 2 and 7) along the path of the conveyor 2' linking the outlet from the unstacker store 3' to the inlet of the printer 1'.

The optical reader 4' is analogous to the optical reader 4 and will not be described in more detail here. A processor-based logic unit 0' achieves harmonious control of the various units according to the information supplied by the optical reader and by the manual coding arrangement.

As previously, a switching device 5' enables different branches 2D1' and 2D2' to be used for letters retained for processing by the optical reader 4' and those passed directly to the operator at his request. Like the optical reader 4 of the previous example, the optical reader 4' has a window opening onto the conveyor 2' and enabling it to scan one side of the passing letters. The window of the optical reader extends over an area enabling a vertical row of photodiodes to scan the letter as it passes by horizontally. This window, which is not shown, is bordered at its lateral edges by letter feeding pulleys or belts and there is disposed parallel to it a device for immobilizing a letter before the window and then releasing it on command.

The branch 2D1' along which letters are fed directly to the operator is directed towards a buffer store 7' in which letters that the operator will have to analyze accmulate, these letters being coded by means of a manual coding arrangement 6' identical to the arrangement 6 described previously.

The buffer store 7' comprises a vertical level changer device which is used to lower the letters from the level on which they have previously been processed, in other words essentially by the optical reader 4', to the lower level on which they will be processed by the printer 1' in particular and by a sorting system 15.

The branch 2D2' is at the higher level like the optical reader 4', the branch 2D1' and the buffer store 7'; it is provided with a barrier 9' having an analogous function to the barrier 9, that is to say to temporarily halt a letter and the next letter following it. This applies in particular to letters for which reading has been terminated but analysis of the information is still in progress, in order to determine whether the information needed for coding them has been obtained or intervention of an operator is required. In the former case, that is to say if the coding information has been obtained, a switching device 8' analogous to the switching device 8 of FIG. 1 routes the letter concerned towards a level changer device 16 under the control of the logic unit 0' alerted by the optical reader 4' to the fact that it has to control the switching device 8' via the link L5'; likewise it controls the barrier 9' and the switching device 5 via respective links L6'and L4'.

In the latter case the switching device 8' routes the letter concerned towards the buffer store 7' via a merging device 17 identical to the merging device 10 in FIG. 1, this merging device 17 also being situated at the higher level.

Figure 7:
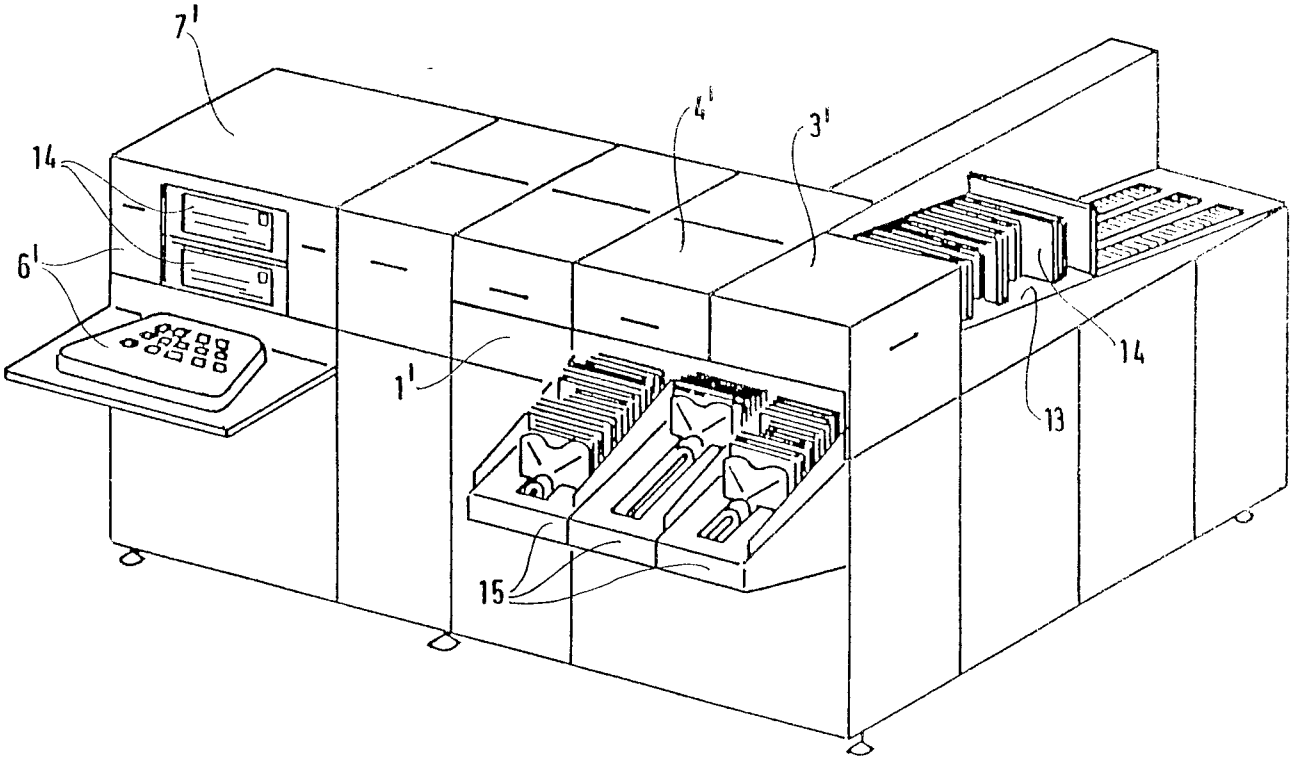
FIG. 7 is a general external view of a sorting machine in accordance with the invention.

The level changer store 7' feeds the manual coding arrangement 6', enabling the operator to view two letters simultaneously, one above the other for example as shown in FIG. 7, one letter being examined and the other waiting to be examined.

The manual coding arrangement 6' is connected to the printer by a branch 2D4' of the conveyor 2, a barrier 11' and a merging device 10'. The merging device 10' also receives letters passed from the higher level to this lower level by the level changer device 16. The outlet from the level changer device 16 is connected for this purpose to a branch 2D5' of the conveyor which links it to the merging device 10' via a barrier 12'. The barriers 11' and 12' have the same functions as the barriers 11 and 12 and are therefore constructed and controled in an analogous manner.

The letters examined by the optical reader 4' and/or in the manual coding arrangement 6' are coded by the printer 1' as they pass the printer; they are then presorted according to the codes on them by the sorting system 15 which is equipped with the usual stackers, for example, of which three are symbolically represented in FIG. 7.

The various component parts of the system described above whose structures have not been defined with reference to specific conventional equipment are defined below. In particular, FIG. 3 shows the construction of one example of the so-called horizontal type of unstacker store 3 or 3'.

Figure 3:
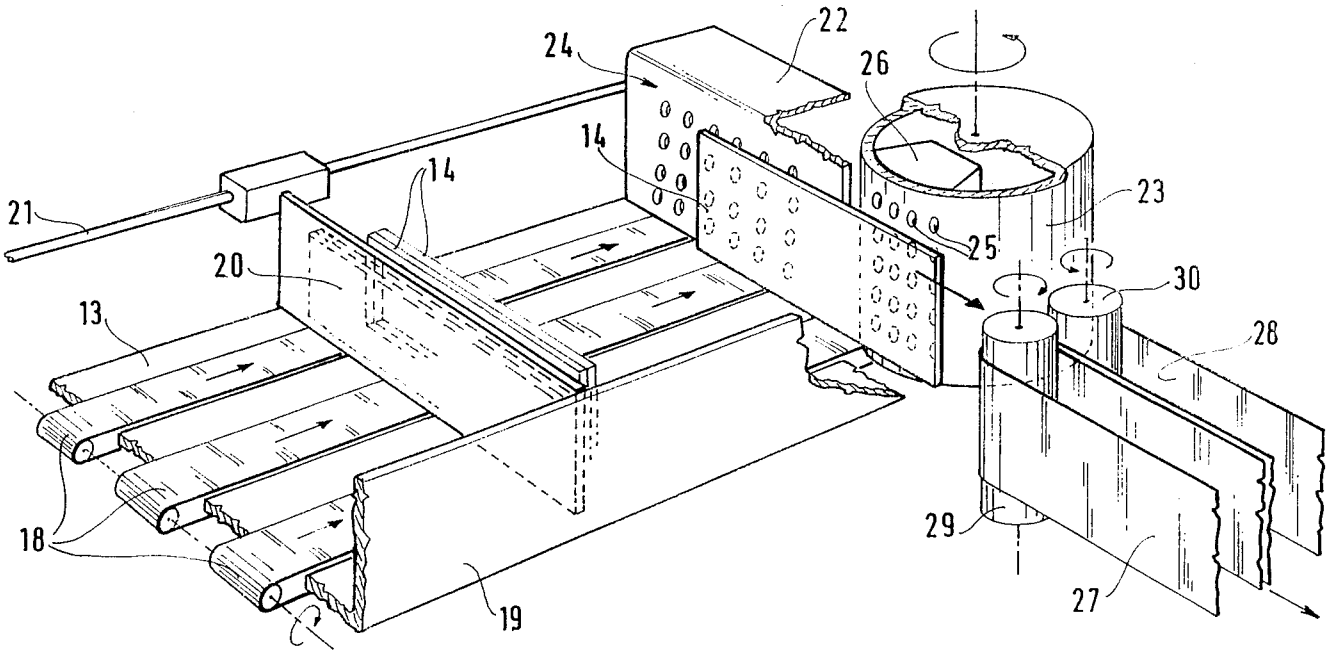
FIG. 3 shows one example of an unstacker store for the coding system in accordance with the invention.

In this embodiment, and as also shown in FIG. 7, the letters are stored in a single stack on a floor 13 sloping slightly upwards towards the unstacker device proper which is situated in the top righthand corner of FIG. 3.

The store is of the conventional kind and comprises a floor 13 fitted with longitudinal drive belts 18 having a rough or notched surface so as to move letters 14 disposed vertically on the floor towards the unstacker device. The floor 13 is bordered at one longitudinal edge by a jolting wall 19 against which the letters are aligned by one lateral edge.

A plate 20 is applied against the side of the letter terminating a bundle of letters facing away from the unstacker device and at the bottom of the bundle in the embodiment shown in FIG. 7. The plate 20 (FIG. 3) is movable, sliding for example along a guide rod 21 which holds it perpendicular to the jolting edge 19 and to the floor 13; it is entrained by the belts 18 on which its bottom edge rests.

Bundles of letters are placed against the plate 20 with this in a position away from the unstacker device which is itself situated transversely at the end of the floor. The unstacker device comprises a suction box 22 transverse to the end of the floor and an unstacker drum 23 the top of which is here shown cut away; the drum is laterally juxtaposed to the box at the end of the floor in the vicinity of the jolting wall 19.

A perforated wall 24 of the suction box 22 is parallel to and faces the plate 20; it applies suction to the letter immediately adjacent it, the side of which facing it is held against it and against the unstacker drum 23. The latter has suction orifices 25 in vertical rows over part of its periphery and comprises internally a suction nozzle 26 which has an opening parallel to the perforated wall 24 of the box so as to provide suction in the direction from the store towards the interior of the drum when the suction orifices 25 pass in front of the opening. The suction nozzle 26 is connected to a conventional pumping device by a solenoid valve actuated by the logic unit 0 at the command of the optical reader or of the operator; the suction device and the solenoid valve, which are of conventional design, are not shown in the figures.

The unstacker drum 23 rotates continuously, in this instance anticlockwise, so as to entrain the letters successively sucked against it by the suction box 22, in this case towards the right. In order to unstack a letter the drum 23 is depressurized by the solenoid valve and passage of the orifices 25 in the drum in front of the nozzle causes the letter to be sucked against the orifices which then entrain it as they rotate until they pass beyond the opening in the nozzle 26.

The unstacked letter 14 is then taken up in the conventional way by the conveyor which comprises, for example, two endless belts 27, 28 tensioned between different shafts so that the two belts are parallel and pressed one against the other over part of their path, only two of these shaft 29 and 30 being shown. Any letter presented between the shafts 29 and 30 is taken up between the pressed together runs of the two belts 27, 28 by virtue of rotation of the shafts in the direction indicated in FIG. 3, at least some of these shafts being driven by a motor that is not shown.

Figure 4:
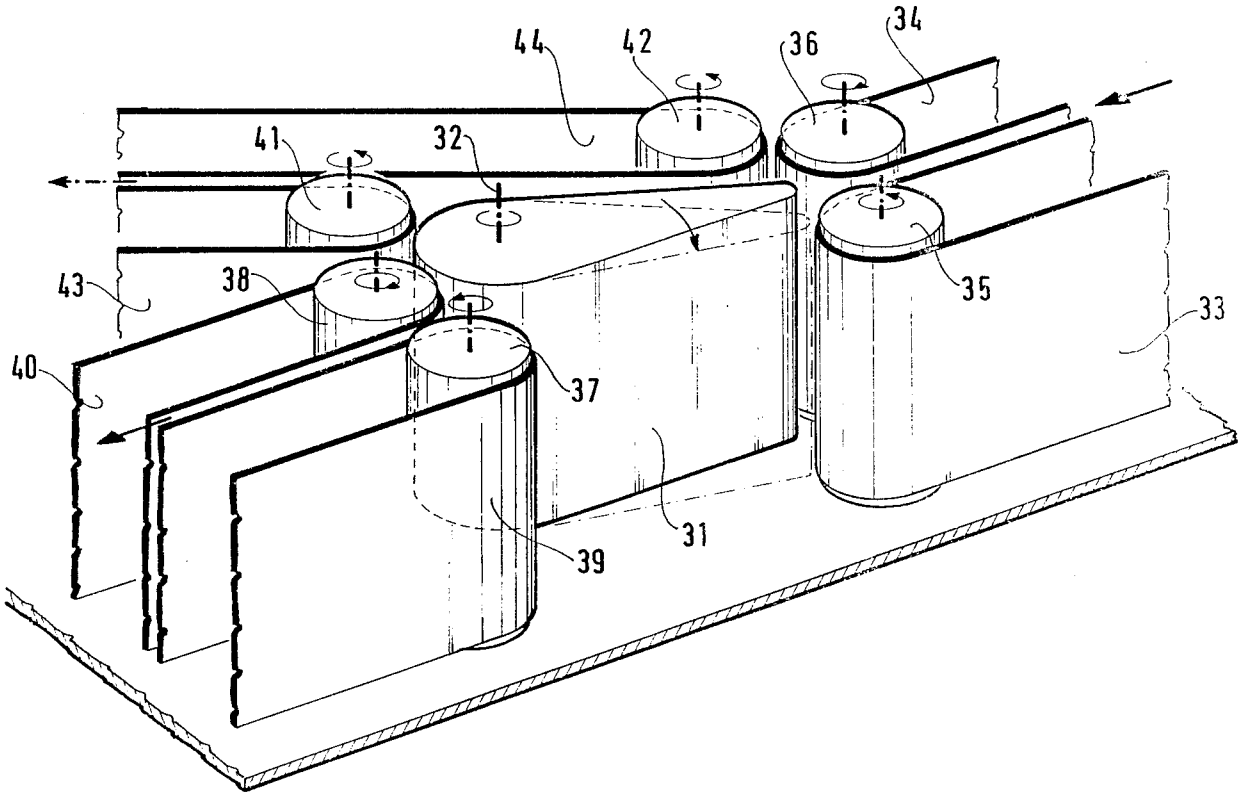
FIG. 4 shows one example of a switching device for the coding system in accordance with the invention.

FIG. 4 shows in outline the construction of a switching device 5 placed between portions of conveyor for transporting letters one by one, here by gripping them between runs moving in parallel, one against the other and in the same direction, of pairs of endless drive belts along the path of the letters. To this end the letters arrive between two juxtaposed runs of two belts 33, 34 terminating in the switching device at two shafts 35, 36 which are practically tangential and have parallel axes; two take-up shafts 37, 38 which are practically tangential and have parallel axes are here aligned with the shafts 35, 36 on the other side of a flap 31 with pivot axis 32. The shafts 37, 38 also carry endless belts 39, 40 which by means of two juxtaposed runs transfer letters from the flap 21 to the branch by virtue of their respective movements. Two take-up shafts 41, 42 with parallel but offset axes form with the endless belts 43, 44 a second branch.

The flap 31 has a transverse cross-section of flattened V shape and is mounted in the vicinity of the take-up shafts to pivot on an axis 32 parallel to the axes of these shafts; it can take either of two alternate positions when acted on by an electromechanical control mechanism that is not shown. In one of these two positions the upper face of the flap enables a letter escaping from between the parallel and juxtaposed runs of the belts 33, 34 to move into the area where the belts 39, 40 meet up between the shafts 37 and 38, in order to be taken up and taken off by the parallel juxtaposed runs of the latter.

In its second position, shown in chain-dotted line in FIG. 4, a letter escaping from between the parallel runs of the belts 33, 34 passes across the lower face of the flap 31 so as to lie against the run of the belt 44 which is juxtaposed with the parallel run of the belt 43, before it is gripped between them in order to be transported away.

Figure 5:
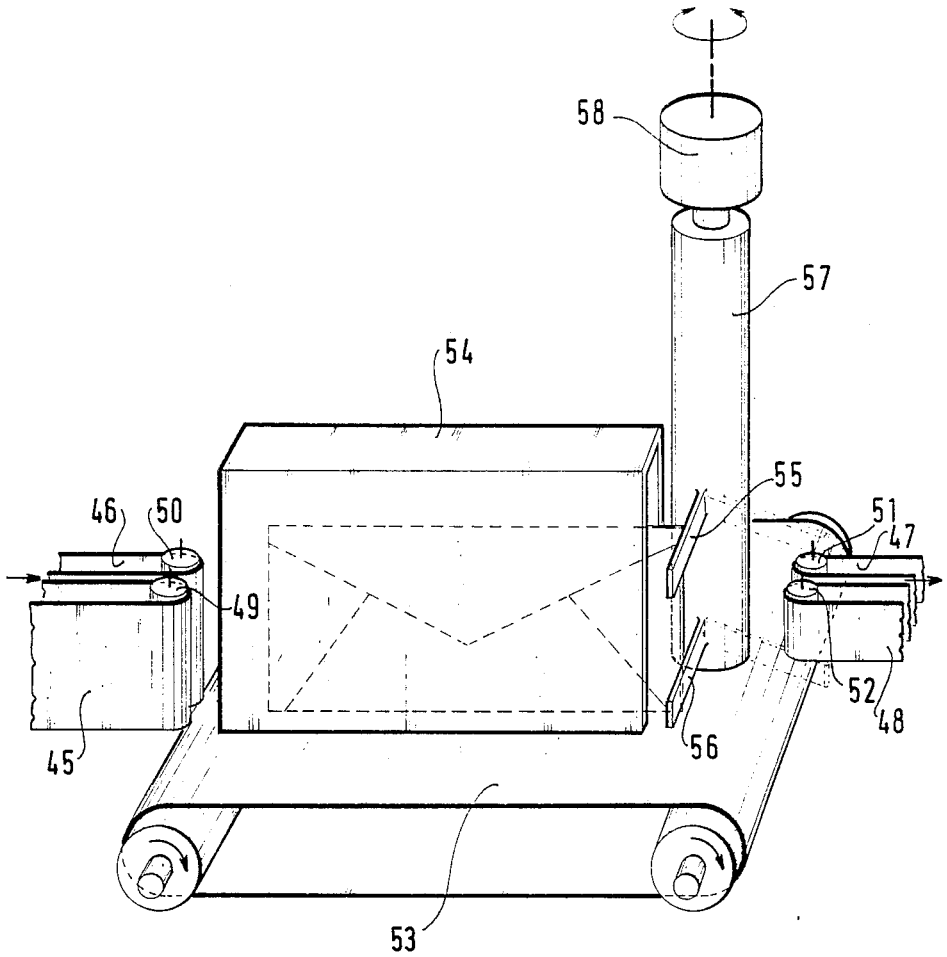
FIG. 5 shows one example of a barrier for the coding system in accordance with the invention.

The barriers 9, 9', 11, 11', 12, 12' are of a known type, one example of which is shown in FIG. 5; they are inserted between two conveyor portions here consisting of the respective pairs of belts 45, 46 and 47, 48 which terminate at end shafts 49, 50, 51, 52 with parallel axes that are practically tangential to each other in pairs. These end shafts are situated at a distance to either side of the barrier proper so that any letter escaping from between the parallel and practically juxtaposed runs of the belts 45 and 46 is passed in a straight line between the parallel and practically juxtaposed runs of the belts 47, 48 through the intermediary of a conveyor belt 53 disposed below the path of the letter perpendicularly to the axis of the end shafts. The letters are held perpendicular to the conveyor belt by a guide member 54 with parallel sides filling most of the space between the end shafts 49, 50 and the end shafts 51, 52.

Two barrier arms 55, 56 are disposed on the path of the letter between the guide member 54 and the end shafts 51 and 52. The barrier arms 55, 56 are here mounted on a column 57 that rotates about an axis perpendicular to the plane of the conveyor belt 53. This enables the arms 55, 56 to be placed before the exit from the guide member 54 on the upstream side of the take-up end shafts 51, 52 in order to halt a letter or to be retracted out of the path of the letter under the control of an electromechanical device 58.

Figure 6:
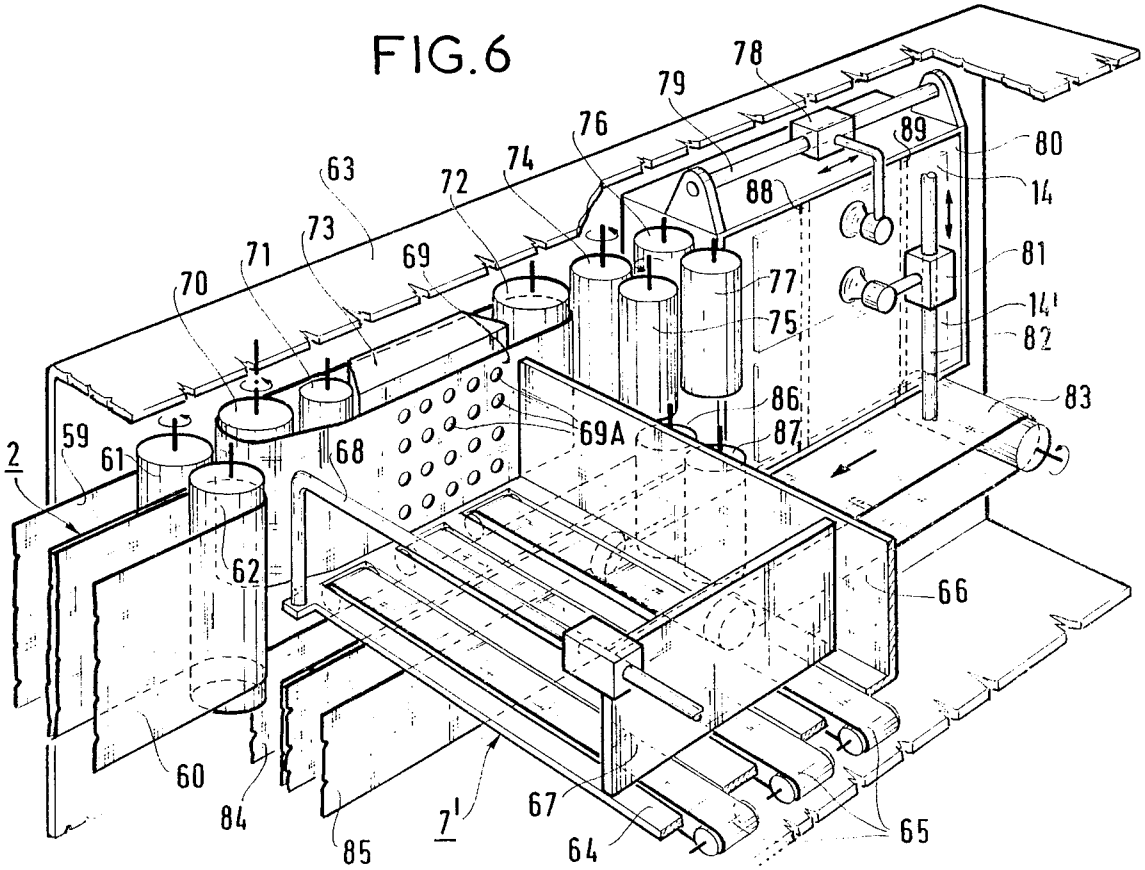
FIG. 6 shows one example of an unstacker store associated with a vertical level changer device for the coding system in accordance with the invention.

The merging device 10, 10', 17 are of conventional design, being constructed for example in an analogous manner to the switching device described with reference to FIG. 4, with the direction of rotation of the pulleys and thus of movement of the belts reversed. The example of an unstacker store with level changer device shown in FIG. 6 is intended to build up a small reserve of letters to be processed by the operator and to carry out the change of level and simulatenous presentation of the letters to be processed before the operator.

To this end the letters to be placed in reserve are passed by the conveyor 2 to the buffer store 7'. The part of the conveyor 2 concerned consists of two endless belts 59, 60 wound on two shafts 61, 62 at the level of the buffer store 7' rotating in opposite directions so that the parallel and juxtaposed runs of the belts 59, 60 which pass between them travel towards the buffer store 7'. The belts 59, 60 and the letters that they carry are at a so-called upper level within the framework 63 containing them. The buffer store 7' is situated at the same upper level and is constructed in a similar manner to the store shown in FIG. 3. In particular, letters are stored in it perpendicularly to a floor 65 provided with transverse drive belt 65, butted up against a jolting wall 66 and stacked up against a plate 67 sliding on a guide rod 68 to which it is perpendicular. The guide rod 68 is parallel to the drive belts 65.

The letters ejected from between the shafts 61, 62 by the belts 59, 60 are slipped onto the top of the stack of letters by an endless belt 69 tensioned between shafts 70, 71, 72 driven in the same direction as the shaft 59. The shaft 70 is parallel to and near the shafts 61, 62 so that the run of belt nearest the store 7' is aligned with the juxtaposed parallel runs of the belts 59, 60, which tends to stack any new letter escaping from between the shafts on the stack of letters perpendicular to the floor 64 resting against the plate 67.

The respective disposition of the shafts 70, 71 is offset in the known manner so as to favor such stacking.

The belt 69 is preferably perforated as at 69A over part of its length with a suction nozzle 73 provided in the vicinity of the shaft 72 and of the jolting wall 67 facing the store 7' and on the other side of the run of belt 69 level with the jolting wall. The suction nozzle 73 is open at the level of the belt 69 over all of the height of this belt; it is conventionally connected to a vacuum pump by a solenoid valve, these two components not being shown here.

When the operator wants to extract a letter from the stack in the store 7' he actuates the solenoid valve feeding the suction nozzle 73 which sucks the letter at the end of the bundle against the belt 69 via the perforations 69*a*.

The letter held against the belt 69 is then entrained towards two pairs of parallel shafts 74, 75, 76, 77 which are juxtaposed in pairs, in between which it passes; the first two shafts 74, 75 are motor-driven and tend to propel the letter in the direction of displacement of the belts, unlike the two shafts 76, 77 which are idler shafts whose function is to hold a letter gripped between them level.

A first sucker device 78 connected to a vacuum pump (not shown) by a solenoid valve (not shown) moves horizontally on a guide rod 79 so that the sucker is placed behind and in the upper central area of any letter emerging from between the shafts 75 and 76 so as to extract it totally and transport it into the central upper part of a window 80 in the frame 63 through which the letter can be seen and if necessary grasped by the operator.

A second sucker device 81 moves vertically on a second guide rod 82 in such a way that its sucker can be positioned immediately under that of the sucker device 78 when the latter is at the extreme position in the center of the upper part of the window.

The sucker device 81 is also connected to a vacuum pump and to a control solenoid valve (not shown) and its sucker is placed behind the letter placed in the upper position by the other sucker device 78 and is moved downwards so as to move the letter to a lower level in which it can still be seen and if necessary grasped by the operator.

In operation two letters 14, 14' are displaced one above the other within the frame of the window 80. The letter in the upper level is held in position either by the sucker of the device 78 or by an additional conventional flap system (not shown) serving to support it; the letter situated at the lower level is held in position by the sucker of the device 81 or by another flap (not shown). When the operator has finished processing the lower letter he uses the keyboard 6 to command (FIGS. 2, 7) simultaneous unstacking of a new letter to be processed and transfer of the letter situated in the lower level of the window to the printer. Suction is no longer applied to the sucker of the device 81 (or the alternative flap is retracted) so that the letter at the lower level drops vertically by means of a chute (not shown) onto a conveyor belt 83 running under the window.

The sucker device 81 is then raised to the high position so that its sucker is applied to the letter carried by the sucker device 78, depressurization of which is then terminated. The sucker device 78 then moves towards the shafts 76, 77 to take up there the letter which has just been unstacked from the store 7'.

The sucker device 81 simultaneously returns to the lower position where it positions the letter that it has taken from the sucker device 78. The latter then returns to its position in the central upper part of the window 80.

The conveyor belt 83 at the lower level feeds the letters that it receives in the opposite direction relative to the belts 59, 60 and to the shafts 74, 75, leading to a new portion of conveyor leading to the printer. This portion here consists of two endless belts 84, 85 would around two shafts 86, 87 so as to lie flush with the upper part of the conveyor belt 83 over which the letters pass.

The walls of the chute that is not shown are shaped so as to hold in a vertical position any letter that drops onto the conveyor, which conducts these letters between the parallel and juxtaposed runs of belts 84, 85 so that these feed them under the store 7' to the printer.

The window is also provided with rear walls (not shown) and front members designed to guide the letters as they move, these front members comprising wires 88, 89 stretched vertically within the frame of the window 80.

The level changer device 16 will not be described in more detail since it may consist of a chute linking the upper level to the lower level between portions of conveyor or a level changer device of the same design as that described hereinabove.

Likewise the sorting system 15 seen in FIGS. 2 and 7 will not be described in more detail as it is a conventional item of equipment in this art and is not directly related to the invention.

We claim:

1. System for coding flat objects according to addressing information marked on objects, comprising: a conveyor, a manual coding station coupled to a printer for printing codes on said objects as they are moved past the printer on said conveyor, an optical system for reading said addressing information located on the path of said conveyor on the upstream side of said coding station and adapted to control said printer so as to automatically print codes on said objects according to said addressing information, and a first switching device on a downstream side of said optical system to route said objects to said printer either directly or via said manual coding station and actuated by said optical system so that if the optical system is unable to read the addressing information on an object, that object is routed to said printer via said manual coding station, a temporary store for said objects at the entry to said manual coding station, and wherein said optical system is situated on a first level and said printer on a second level, and said system further comprising at least two level changer devices on the path of said conveyor, whereby said printer may be fed with said objects either on a first path passing via said optical system and a first of said at least two level changer devices or on a second path coincident with said first path at said optical system and said printer and passing via said temporary store and a second of said at least two level changer devices located upstream of said manual coding station to rejoin said coincident first path at said second level.

2. System according to claim 1, further comprising a barrier downstream of said optical system whereby the time available for said optical system to process an object may be increased by delaying routing of that object to said printer.

3. System according to claim 1, further comprising a second switching device on the path of said conveyor between said optical system and said first switching device for routing said objects selectively to said first switching device or to said manual coding station, as determined by an operator.

4. System according to claim 3, further comprising at least one temporary barrier on the path of said conveyor between said first and second switching devices, a third switching device on the upstream side of said printer and two further temporary barriers on the upstream side of said third switching device, one of said two further temporary barriers on the direct path of said conveyor between said optical system and said printer on the downstream side of said first switching device and the other of said two further temporary barriers on the path of said conveyor between said temporary store and said third switching device downstream of said manual coding station.

5. System according to claim 1, further comprising an access window in said manual coding station and another level changer device for holding two of said objects simultaneously before an operator in said access window, one above the other, and to move each object in succession from one level to the other and with opposite directions of object conveyance at the respective superposed levels.

* * * * *